US010337791B2

(12) United States Patent
Briglia et al.

(10) Patent No.: US 10,337,791 B2
(45) Date of Patent: Jul. 2, 2019

(54) PROCESS AND APPARATUS FOR THE SEPARATION BY CRYOGENIC DISTILLATION OF A MIXTURE OF METHANE, CARBON DIOXIDE AND HYDROGEN

(71) Applicant: L'Air Liquide, Societe Anonyme Pour l'Etude et l'Exploitation des Procedes Georges Claude, Paris (FR)

(72) Inventors: Alain Briglia, Hangzhou (CN); Emmanuelle Brocheriou, Chennevieres sur Marne (FR); Pascal Marty, Bry sur Marne (FR); Bhadri Prasad, Champigny sur Marne (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 645 days.

(21) Appl. No.: 14/398,980

(22) PCT Filed: Apr. 29, 2013

(86) PCT No.: PCT/EP2013/058850
§ 371 (c)(1),
(2) Date: Nov. 5, 2014

(87) PCT Pub. No.: WO2013/167406
PCT Pub. Date: Nov. 14, 2013

(65) Prior Publication Data

US 2015/0114035 A1 Apr. 30, 2015

(30) Foreign Application Priority Data

May 7, 2012 (EP) ..... 12305503

(51) Int. Cl.
*F25J 3/02* (2006.01)
*F25J 5/00* (2006.01)

(52) U.S. Cl.
CPC ..... *F25J 3/0261* (2013.01); *F25J 3/0223* (2013.01); *F25J 3/0233* (2013.01); *F25J 3/0252* (2013.01);
(Continued)

(58) Field of Classification Search
CPC ..... F25J 3/0252; F25J 3/0261; F25J 3/0271; F25J 3/0223
See application file for complete search history.

(56) References Cited

U.S. PATENT DOCUMENTS 2,795,536 A * 6/1957 Pryor ..... B01D 3/20 202/153
4,102,659 A 7/1978 Martin
(Continued)

FOREIGN PATENT DOCUMENTS

| | | |
|---|---|---|
| EP | 0359629 | 3/1990 |
| FR | 2881063 | 7/2006 |
| FR | 2 916 523 A1 | 11/2008 |

OTHER PUBLICATIONS

International Search Report and Written Opinion for corresponding PCT/EP2013/058850, dated Apr. 29, 2013.

*Primary Examiner* — John F Pettitt, III
(74) *Attorney, Agent, or Firm* — Justin K. Murray

(57) ABSTRACT

In a process for the cryogenic separation of a feed mixture of at least carbon monoxide, hydrogen and methane, the feed mixture is separated in a methane wash column fed by a liquid methane stream at the top of the methane wash column to produce a gas enriched in hydrogen, a liquid stream from the bottom of the methane wash column is treated to produce a mixture of carbon monoxide and methane, the mixture of carbon monoxide and methane is
(Continued)

separated in a separation column to produce a gas enriched in carbon monoxide and a liquid methane flow at least part of which forms a purge stream, the purge stream being varied to take account of load variations.

8 Claims, 3 Drawing Sheets

(52) U.S. Cl.
CPC ..... *F25J 5/005* (2013.01); *F25J 2200/70* (2013.01); *F25J 2200/76* (2013.01); *F25J 2200/90* (2013.01); *F25J 2205/30* (2013.01); *F25J 2235/60* (2013.01); *F25J 2250/02* (2013.01); *F25J 2270/24* (2013.01); *F25J 2280/02* (2013.01); *F25J 2290/62* (2013.01)

(56) References Cited

U.S. PATENT DOCUMENTS

| | | | | | |
|---|---|---|---|---|---|
| 5,260,865 | A * | 11/1993 | Beauford | B01D 3/425 | 203/1 |
| 6,348,637 | B1 * | 2/2002 | Harris | B01D 3/141 | 208/347 |
| 7,617,701 | B2 * | 11/2009 | Billy | C01B 3/506 | 62/617 |
| 8,192,525 | B2 * | 6/2012 | Teixeira | B01D 53/04 | 62/617 |
| 2011/0138853 | A1 * | 6/2011 | Haik-Beraud | C01B 3/382 | 62/617 |

* cited by examiner

PROCESS AND APPARATUS FOR THE SEPARATION BY CRYOGENIC DISTILLATION OF A MIXTURE OF METHANE, CARBON DIOXIDE AND HYDROGEN

CROSS REFERENCE TO RELATED APPLICATIONS

This application is a § 371 of International PCT Application PCT/EP2013/058850, filed Apr. 29, 2013, which claims the benefit of EP12305503.0, filed May 7, 2012, both of which are herein incorporated by reference in their entireties.

TECHNICAL FIELD OF THE INVENTION

The present invention relates to a process and to an apparatus for the separation by cryogenic distillation of a mixture of methane, carbon dioxide and hydrogen. The mixture may also contain nitrogen. Preferably the mixture contains at least 2% methane, all the percentages relating to purities in this document being molar percentages.

BACKGROUND

The speed of change of production requirement for a unit producing carbon monoxide and hydrogen, in connection with a synthesis gas generation unit, a $CO_2$ removal unit and a cold box, is highly dependent on the time of reaction of the cold box.

In a process as described in EP-A-0359629, the acceptable variations of the feed stream at the entrance of the cooling system upstream of the cryogenic separation are very limited. If the changes in feed flow are excessive, the cryogenic separation does not perform correctly and so the speed of feed change is limited to changes of 0.5% of the nominal flow per minute.

Since the synthesis gas generator can react more quickly than the cryogenic separation to changes in feed flow, this means that the cryogenic separation determines the maximum flowrate change.

It has been proposed to use a storage tank containing liquid carbon monoxide to improve the speed of variation of feed flow to produce carbon monoxide. When the demand for carbon monoxide increases quickly, the storage tank is emptied and the carbon monoxide is vaporized in an external vaporizer. This solution does not provide for a fast increase in supply of hydrogen.

Furthermore the storage of large amounts of liquid carbon monoxide presents a security hazard.

SUMMARY OF THE INVENTION

Certain embodiments of the present invention are intended to increase the speed of change of flowrate for carbon monoxide and hydrogen and to make those changes easier to implement.

According to certain embodiments of the invention, the molecules of liquid methane are stored within the process, preferably downstream of the $CO/CH_4$ column and upstream of the methane wash column.

The liquid methane in a purification unit for synthesis gas serves two purposes:

purification of hydrogen in the wash column, provision of refrigeration by vaporization of the liquid methane purge in the heat exchange line.

A process according to the preamble of Claim 1 is shown in U.S. Pat. No. 4,102,659.

In liquid methane wash processes, when comparing the amount of liquid within the process (essentially in the columns, where the feed flow change is present), the amount of liquid methane varies far more than the liquid carbon monoxide.

For a given plant the variation of the amount of liquid methane varies about 4 times mores than the amount of liquid carbon monoxide, whereas the feed gas contains 4 times less methane than carbon monoxide, and sometimes more than 4 times less.

Consequently it is very slow to build up the amount of liquid methane in the unit, in particular when the amount of feed to be separated increases.

It is therefore impossible to increase the feed flow by several % of the nominal flow per minute without controlling the liquid methane within the system.

The amount of liquid methane includes the volume of methane in the heat exchangers, the volume of methane in the piping, the volume of methane in the column distributors, the volume of methane in the column packings and the volume of methane in the bottom of columns.

When product demands or feed flow reduces, the amount of liquid held in the distributors reduces. The liquid, rich in methane, tends to fall into the sump of the column and the liquid level there rises. Previously, the solution, as shown in FR-A-2881063, was to vary the methane purge as a function of the column liquid level. Typically, the process increased the methane purge, to keep the liquid level constant. However this makes the process unstable.

The advantages of the process are that the use of a carbon monoxide storage tank can be avoided, variations in demand for hydrogen and carbon monoxide can be accommodated and the overall amount of liquid carbon monoxide in the process can be decreased.

The amount of synthesis gas entering the cold box regulates a number of control points in particular for the wash liquid flow, the reboil flow for the flash column and $CO/CH_4$ column and the cycle flowrate. The other control points do not depend on the synthesis flow rate, in particular the methane purge flowrate which depends only on the amount of methane in the system.

Consequently according to the prior art, when the amount of synthesis gas is reduced, the amount of gas and liquid in the columns changes and the amount of collected liquid reduces. The flowrate of purge methane depends on the amount of methane in the system and so the amount purged and vaporised can increase when the synthesis gas flowrate decreases. Since the increased methane vaporisation seriously affects the thermal equilibrium of the heat exchange line, this contrary effect perturbs the operation of the system and makes it difficult to change flowrates quickly.

When the synthesis gas flow rate increases, the amount of liquid in the columns has to build up, and the methane purge flowrate tends to reduce. This also affects the heat exchange line, as explained above.

By using a methane storage tank, the liquid can be stored when the feed flowrate reduces and used when the flowrate increases. Thus the methane purge is no longer an element which destabilizes the heat exchange line.

According to an object of the invention, there is provided a process for the cryogenic separation of a feed mixture of at least carbon monoxide, hydrogen and at least 2% methane wherein:

i) the feed mixture is separated in a methane wash column fed by a liquid methane stream at the top of the methane wash column to produce a gas enriched in hydrogen, the volume of the liquid methane stream of step i) being varied to take account of varying demands for the gas enriched in carbon monoxide and/or the gas enriched in hydrogen ii) a liquid stream from the bottom of the methane wash column is treated to produce a mixture of carbon monoxide and methane, iii) the mixture of carbon monoxide and methane is separated in a separation column to produce a gas enriched in carbon monoxide and a liquid methane flow a first part of which forms the liquid methane stream of step i), iv) a second part of the liquid methane flow is removed from the process as a purge stream and characterized in that the flowrate of the second part is varied as a function of the feed mixture flowrate.

According to optional features:

- the liquid methane is removed from the separation column and stored in a storage tank, the liquid level of which varies to account for the varying amount of liquid sent to the methane wash column.
- the amount of liquid methane removed from the separation column is regulated so that the liquid level at the bottom of the separation column is constant.
- the liquid level in the storage tank decreases if the synthesis gas flowrate increases.
- the volume of the liquid methane stream of step i) increases with an increase in demand for the gas enriched in carbon monoxide and/or the gas enriched in hydrogen and/or an increase in the amount of feed mixture separated in the methane wash column.
- the liquid methane to be sent to the methane wash column is stored at the bottom of the carbon monoxide/methane column, the bottom of the carbon monoxide/methane column comprising a reboiler section operates at constant level and a storage section from which the liquid methane is withdrawn, operating with a variable level.
- the flowrate of the purge stream is controlled with a lead time with respect to the feed mixture flowrate.
- the flowrate of the purge stream is controlled with a lag time with respect to the feed mixture flowrate.
- the purge stream vaporizes by heat exchange with the feed mixture.
- the purge stream flowrate increases if the feed mixture flowrate increases and decreases if the feed mixture flowrate decreases.
- the liquid methane is not stored in a storage tank and wherein if the feed mixture flowrate increases, the liquid level in the separation column decreases.

According to another object of the invention, there is provided an apparatus for the cryogenic separation of a feed mixture of at least carbon monoxide, hydrogen and methane comprising a cryogenic enclosure and within the cryogenic enclosure, a heat exchanger, a methane wash column, a separation column, treatment means, a conduit for sending the feed mixture to be separated in the methane wash column, a conduit for sending a liquid methane stream to the top of the methane wash column, a conduit for removing a gas enriched in hydrogen from the methane wash column, a conduit for sending a liquid stream from the bottom of the methane wash column to the treatment means to be treated to produce a mixture of carbon monoxide and methane, a conduit for sending the mixture of carbon monoxide and methane to be separated in the separation column, a conduit for removing a gas enriched in carbon monoxide from the separation column, a conduit for removing a liquid methane flow from the separation column, means for removing a first part of the liquid methane flow to form the liquid methane stream and means for increasing the volume of the liquid methane stream in dependence on an increased demand for the gas enriched in carbon monoxide and/or the gas enriched in hydrogen and/or an increased amount of feed mixture sent to the methane wash column, means for removing a second part of the liquid methane flow as a purge flow and characterized in that it comprises means for varying the flowrate of the second part as a function of the feed mixture flowrate.

According to other optional features, the apparatus comprises:

- means for sending the purge flow to the heat exchanger.
- a storage tank wherein the liquid methane removed from the separation column is stored, the liquid level of the storage tank being variable to account for the varying amount of liquid sent to the methane wash column.
- a storage section at the bottom of the separation column, capable of receiving overflow liquid from a reboiler section at the bottom of the separation column.
- the treatment means comprises a column, connected at the top to the conduit for sending a liquid stream from the bottom of the methane wash column to the treatment means and at the bottom to the conduit for sending the mixture of carbon monoxide and methane to be separated in the carbon monoxide/methane column.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

The invention will be described in greater detail with reference to the figures.

Figure 1:
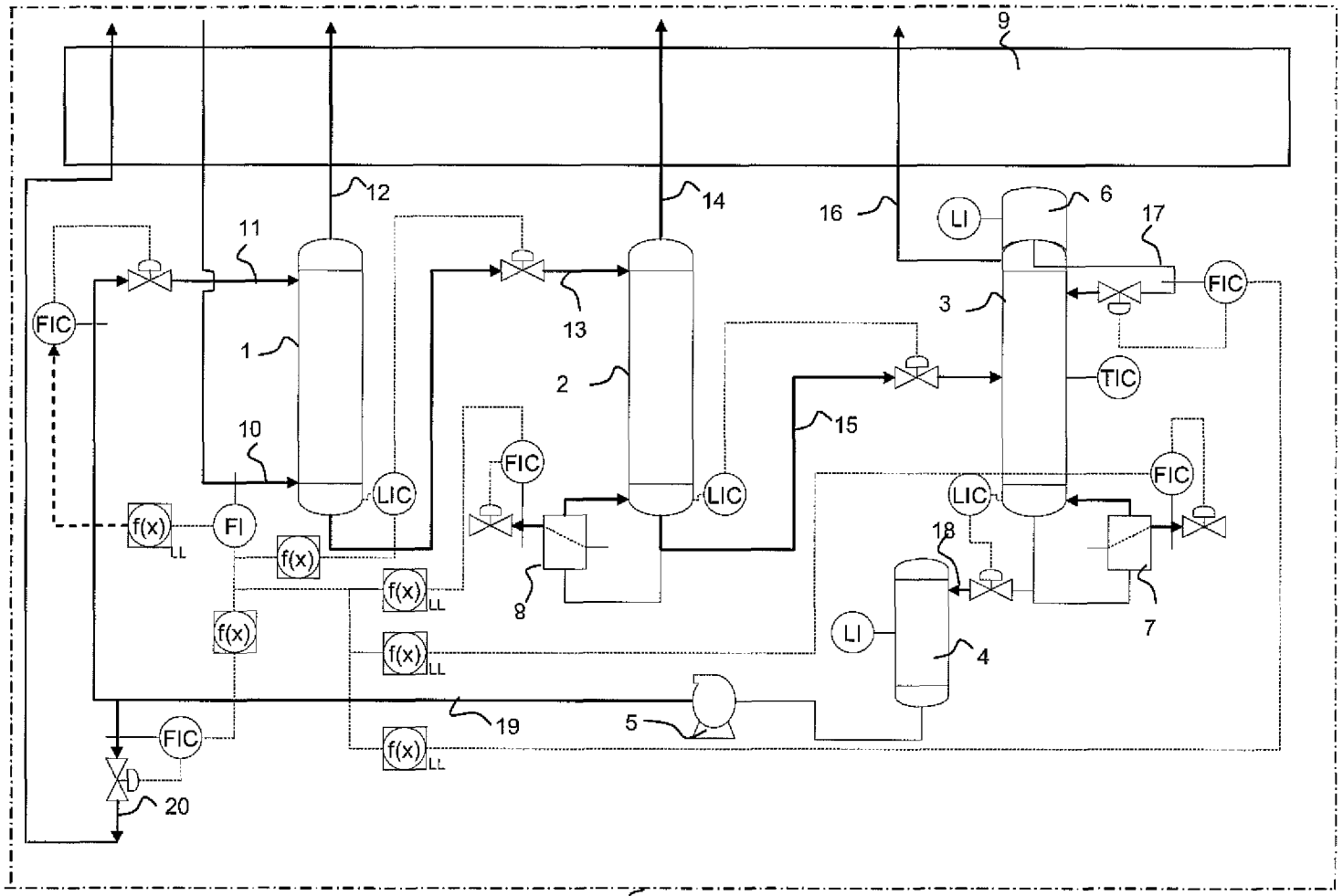
FIG. 1 provides a process of an embodiment of the invention.
Figure 2:
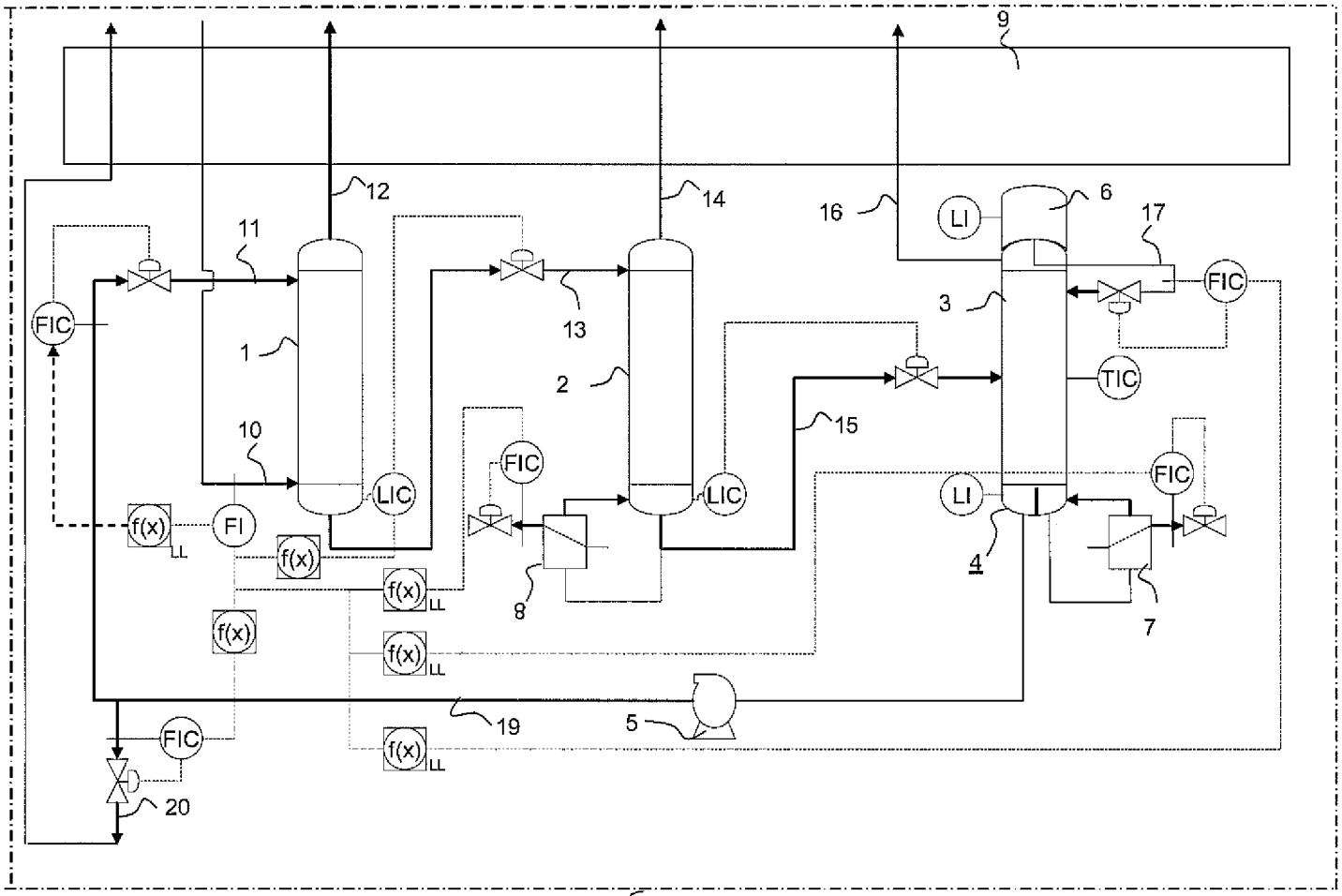
FIG. 2 provides a process of an embodiment of the invention.
Figure 3:
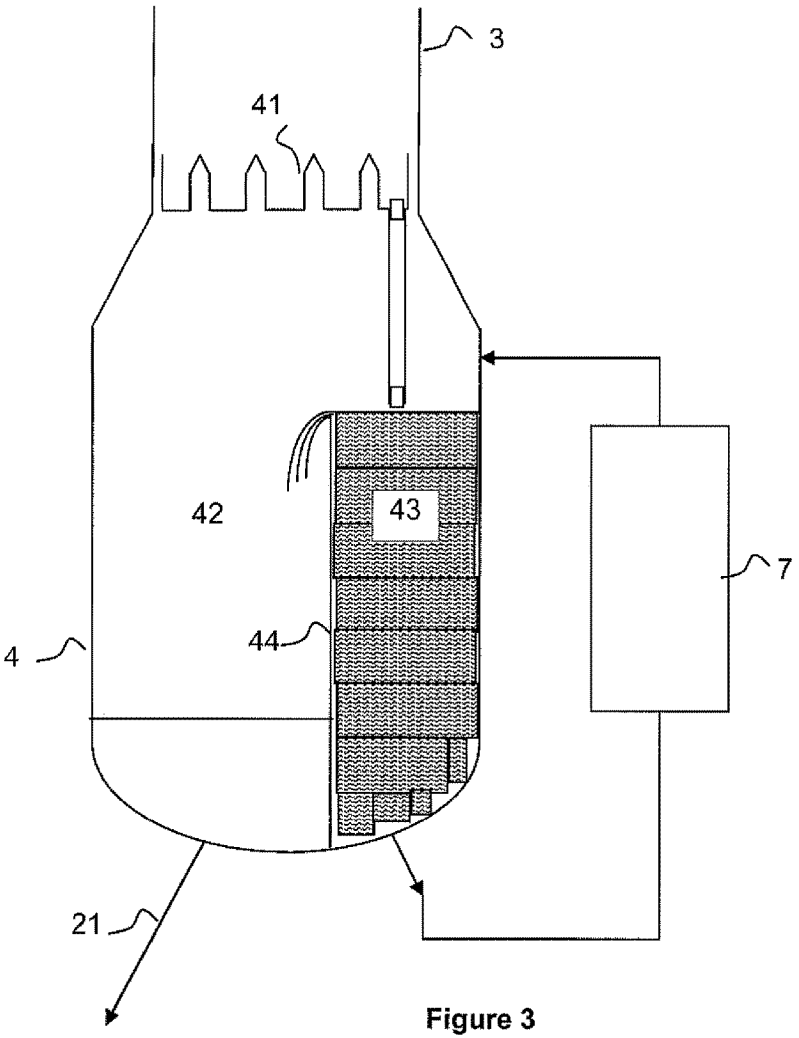
FIG. 3 provides additional details of the embodiment of FIG. 2.

FIGS. 1 and 2 show processes according to the invention and FIG. 3 shows a detail of the process of FIG. 2.

The process is a cryogenic separation process taking place within a cold box 30.

A feed stream 10 cooled in heat exchanger 9 and containing hydrogen, carbon monoxide and at least 2% methane is sent to the bottom of a methane wash column 1 fed by liquid methane 11 at the top of the column.

A gas enriched in hydrogen 12 is removed at the top of the methane wash column 1 and warmed in the heat exchanger 9. A liquid 13 with a reduced hydrogen content is sent to a flash column 2 having a bottom reboiler 8. Gas 14 is removed from the top of the flash column and warmed in heat exchanger 9.

The bottom liquid 15 from the flash column contains principally carbon monoxide and methane and is sent to the middle of a carbon monoxide/methane column 3 having a reflux capacity (or a condenser) 6 and a bottom reboiler 7. Liquid 17 from the reflux capacity 6 is sent back to column 3.

Carbon monoxide rich gas 16 is removed from the top of column 3 and sent to heat exchanger 9.

Methane rich liquid 18 is removed from the bottom of the column 3. The liquid from the tank 4 is pumped using pump 5 and divided into two parts (or even three parts). One part 11 is sent to the top of the methane wash column 1, the other part 20 is removed, possibly as a product. The second part may be vaporized in heat exchanger 9.

The process can be controlled as follows:

The flowrate of the synthesis gas feed stream 10 is measured. Variations of this stream 10 are used to lead or lag other process parameters in order to ensure the plant load change.

Liquid methane stream 11 feeding the methane wash column 1 at the top is controlled in flow. The set-point of this flow controller is set via a calculation which is a function of the total synthesis gas flow 10. A lead or a lag time can be applied to the value of the set-point according the dynamics of the system.

The sump level of the methane wash column 1 is controlled by the stream 13 extraction from the bottom of the methane wash column. The set point of this level controller will also be linked to the variation of the synthesis gas stream 10. This level set point will vary in the opposite direction to the plant load; this is the result of the liquid inventory variation in the distributors in the methane wash column 1.

The streams used to heat reboilers 7 and 8 are controlled in flow. The set-points of these flow controllers are set via calculations which are function of the total synthesis gas flow 10. A lead or a lag time can be applied to the value of the set-point according the dynamics of the system.

Sump level of the column 2 is maintained constant, by the stream 15 extraction.

Reflux 17 is controlled in flow. The set-point of this flow controller is set via a calculation which is a function of the total synthesis gas flow 10. A lead or a lag time can be applied to the value of the set-point according the dynamics of the system. This set point also can be corrected by a temperature controller set in the middle of the carbon monoxide/methane column 3.

Sump level of the carbon monoxide/methane column 3 is maintained constant, by the stream 18 extraction.

Methane purge flow 20 is also controlled in flow. The set-point of this flow controller is set via a calculation which is a function of the total synthesis gas flow 10 so that the methane purge flow 20 increases when the synthesis gas flow 10 increases and decreases when the synthesis gas flow decreases. A lead or a lag time can be applied to the value of the set-point according the dynamics of the system.

As a consequence, the level in tank 4 and the reflux capacity 6 will vary according the load of the plant. Thus if the synthesis gas flowrate increases, the level in the tank 4 will fall to allow the purge flow 20 to increase whilst leaving the liquid level in the column 3 constant. Similarly if the synthesis gas flowrate decreases, the level in the tank 4 will increase to allow the purge flow 20 to decrease whilst leaving the liquid level in the column 3 constant.

Tank 4 will accumulate the methane molecules resulting from a load decrease due to the inventory change in the column liquid distributors. This accumulated methane will be used again during the load increase to reload the distributors of the methane wash column 1 with methane.

Reflux capacity 6 will accumulate the liquid carbon monoxide molecules resulting from a load decrease due to the inventory change in the column liquid distributors. This accumulated liquid carbon monoxide will be used again during the load increase to reload the distributors.

FIG. 2 shows processes according to the invention similar to FIG. 1, with the exception of the tank 4 which is integrated in the sump of carbon monoxide/methane column 3. In this case, it is the liquid level at the bottom of column 3 which will increase or decrease in response to the synthesis gas flowrate, so that the purge flow 20 may increase when the synthesis gas flowrate increases and vice versa.

In both FIGS. 1 and 2, the column 2 may be fed at the top with pumped methane liquid from pump 5.

The tank 4 may be integrated into the bottom of the carbon monoxide/methane column 3 (as shown in FIG. 3).

Element 41 at the bottom of column 3 is a liquid distributor and collector which allows falling liquid to be sent from the packing above the distributor to the reboiler section 43 at one side of the sump of column 3. Tank 4 is the section 42 at the other side of the sump of column 3, separated by a partition plate 44 from where stream 21 is withdrawn to feed the pump 5.

The reboiler section 43 operates at constant level and overflows into the tank section 42 where the methane inventory varies according to the plant load.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary a range is expressed, it is to be understood that another embodiment is from the one.

Optional or optionally means that the subsequently described event or circumstances may or may not occur. The description includes instances where the event or circumstance occurs and instances where it does not occur.

Ranges may be expressed herein as from about one particular value, and/or to about another particular value. When such particular value and/or to the other particular value, along with all combinations within said range.

All references identified herein are each hereby incorporated by reference into this application in their entireties, as well as for the specific information for which each is cited.

The invention claimed is:

1. A process for controlling a cryogenic separation of a feed mixture comprising carbon monoxide, hydrogen and at least 2% methane, the process comprising the steps of:

i) providing the feed mixture to a cold box, wherein the feed mixture is sourced from a syngas production facility, wherein a flow rate of the feed mixture is measured;

ii) cooling the feed mixture in a heat exchanger to produce a cold feed mixture at a first temperature;

iii) introducing the cold feed mixture to a methane wash column to produce a gas enriched in hydrogen and a liquid reduced in hydrogen;

iv) withdrawing the liquid reduced in hydrogen from the methane wash column and introducing the liquid reduced in hydrogen to a flash column to produce an impure hydrogen gas at a top portion of the flash column and a bottoms liquid comprising carbon monoxide and methane, wherein the flash column comprises a bottom reboiler;

v) introducing the bottoms liquid to a distillation column to produce a carbon monoxide-rich top gas and a methane-rich bottoms liquid;

vi) removing the methane-rich bottoms liquid from a bottom section of the distillation column;

vii) introducing a first portion of the methane-rich bottoms liquid to the methane wash column;

viii) vaporizing a second portion of the methane-rich bottoms liquid in the heat exchanger against the feed mixture;

wherein the bottom section of the distillation column comprises a liquid distributor, a reboiler section, and a storage section, wherein the liquid distributor is configured to receive falling liquid from within the distillation column and send the falling liquid to the reboiler section, wherein the storage section is configured to receive an overflow liquid from the reboiler section, wherein the liquid distributor is disposed above the storage section and the reboiler section, wherein the reboiler section and the storage section are disposed side by side within the bottom section of the distillation column, wherein a partition wall separates the storage section from the reboiler section, wherein the methane-rich bottoms liquid removed in step vi) is removed from the storage section of the bottom section; and ix) adjusting a flow rate of the methane-rich bottoms liquid removed from the bottom section in step vi) based on the flow rate of the feed mixture, wherein a flow rate of the second portion of the methane-rich bottoms liquid that is vaporized in the heat exchanger is adjusted higher if the measured flow rate of the feed mixture increases and is adjusted lower if the measured flow rate of the feed mixture decreases, wherein the flow rate of the second portion of the methane-rich bottoms liquid vaporized in the heat exchanger is adjusted in order to maintain the cold feed mixture at the first temperature.

2. The process according to claim 1, wherein a volume of liquid kept in the storage section fluctuates while the reboiler section is configured to operate with a constant liquid level.

3. The process according to claim 1, wherein a liquid level within the methane wash column is controlled by adjusting a flow rate of the liquid reduced in hydrogen withdrawn from the methane wash column in step iv), wherein the liquid level within the methane wash column has a set point that is based on the measured flow rate of the feed mixture.

4. The process according to claim 1, wherein a set point of a liquid level in the methane wash column is adjusted lower if the measured flow rate of the feed mixture increases and is adjusted higher if the measured flow rate of the feed mixture decreases.

5. The process according to claim 1, wherein, in the event of a change in the measured flow rate of the feed mixture, a sump level within the flash column is maintained constant by altering a flow rate of the bottoms liquid withdrawn from the flash column.

6. The process according to claim 1, wherein a volume of liquid in the storage section varies inversely based on the measured flow rate of the feed mixture while the reboiler section is configured to operate with a constant liquid level.

7. A process for controlling a cryogenic separation of a feed mixture comprising carbon monoxide, hydrogen and at least 2% methane, the process comprising the steps of:

i) providing the feed mixture to a cold box, wherein the feed mixture is sourced from a syngas production facility, wherein a flow rate of the feed mixture is measured;

ii) cooling the feed mixture in a heat exchanger to produce a cold feed mixture at a first temperature;

iii) introducing the cold feed mixture to a methane wash column to produce a gas enriched in hydrogen and a liquid reduced in hydrogen;

iv) withdrawing the liquid reduced in hydrogen from the methane wash column and introducing the liquid reduced in hydrogen to a flash column to produce an impure hydrogen gas at a top portion of the flash column and a bottoms liquid comprising carbon monoxide and methane, wherein the flash column comprises a bottom reboiler;

v) introducing the bottoms liquid to a distillation column to produce a carbon monoxide-rich top gas and a methane-rich bottoms liquid;

vi) removing the methane-rich bottoms liquid from a bottom section of the distillation column;

vii) introducing a first portion of the methane-rich bottoms liquid to the methane wash column;

viii) vaporizing a second portion of the methane-rich bottoms liquid in the heat exchanger against the feed mixture;

wherein the bottom section of the distillation column comprises a liquid distributor, a reboiler section, and a storage section, wherein the liquid distributor is configured to receive falling liquid from within the distillation column and send the falling liquid to the reboiler section, wherein the storage section is configured to receive an overflow liquid from the reboiler section, wherein the liquid distributor is disposed above the storage section and the reboiler section, wherein the reboiler section and the storage section are disposed side by side within the bottom section of the distillation column, wherein a partition wall separates the storage section from the reboiler section, wherein the methane-rich bottoms liquid removed in step vi) is removed from the storage section of the bottom section; and ix) adjusting a flow rate of the methane-rich bottoms liquid removed from the bottom section in step vi) based on the flow rate of the feed mixture, wherein a volume of liquid kept in the storage section fluctuates while the reboiler section is configured to operate with a constant liquid level, wherein a set point of a liquid level in the methane wash column is adjusted lower if the measured flow rate of the feed mixture increases and is adjusted higher if the measured flow rate of the feed mixture decreases, wherein, in the event of a change in the measured flow rate of the feed mixture, a sump level within the flash column is maintained constant by altering a flow rate of the bottoms liquid withdrawn from the flash column, wherein a flow rate of the second portion of the methane-rich bottoms liquid that is vaporized in the heat exchanger is adjusted higher if the measured flow rate of the feed mixture increases and is adjusted lower if the measured flow rate of the feed mixture decreases, wherein the flow rate of the second portion of the methane-rich bottoms liquid vaporized in the heat exchanger is adjusted in an amount effective to maintain the cold feed mixture at the first temperature, wherein a volume of liquid in the storage section reduces when the flow rate of the second portion of the methane-rich bottoms liquid vaporized in the heat exchanger increases, wherein the volume of liquid in the storage section increases when the flow rate of the second portion of the methane-rich bottoms liquid vaporized in the heat exchanger decreases.

8. A process for controlling a cryogenic separation of a feed mixture comprising carbon monoxide, hydrogen and at least 2% methane, the process comprising the steps of:

i) providing the feed mixture to a cold box, wherein the feed mixture is sourced from a syngas production facility, wherein a flow rate of the feed mixture is measured;

ii) cooling the feed mixture in a heat exchanger to produce a cold feed mixture at a first temperature;

iii) introducing the cold feed mixture to a methane wash column to produce a gas enriched in hydrogen and a liquid reduced in hydrogen;

iv) withdrawing the liquid reduced in hydrogen from the methane wash column and introducing the liquid reduced in hydrogen to a flash column to produce an impure hydrogen gas at a top portion of the flash column and a bottoms liquid comprising carbon monoxide and methane, wherein the flash column comprises a bottom reboiler;

v) introducing the bottoms liquid to a distillation column to produce a carbon monoxide-rich top gas and a methane-rich bottoms liquid, wherein the distillation column comprises a reflux capacity or condenser, wherein the distillation column also comprises a bottom section, wherein the bottom section of the distillation column comprises a liquid distributor, a reboiler section, and a storage section, wherein the liquid distributor is configured to receive falling liquid from within the distillation column and send the falling liquid to the reboiler section, wherein the storage section is configured to receive an overflow liquid from the reboiler section, wherein the liquid distributor is disposed above the storage section and the reboiler section, wherein the reboiler section and the storage section are disposed side by side within the bottom section of the distillation column, wherein a partition wall separates the storage section from the reboiler section;

vi) removing the methane-rich bottoms liquid from the storage section of the distillation column;

vii) introducing a first portion of the methane-rich bottoms liquid to the methane wash column;

viii) vaporizing a second portion of the methane-rich bottoms liquid in the heat exchanger against the feed mixture;

ix) making the following adjustments if the measured flow rate of the feed mixture is increased:

a. increasing the amount of the second portion of the methane-rich bottoms liquid that is vaporized in the heat exchanger against the feed mixture in order to maintain the cold feed mixture at the first temperature;

b. increasing the flow rate of the methane-rich bottoms liquid withdrawn from the storage section of the distillation column, thereby lowering the volume of liquid within the storage section of the distillation column; and x) making the following adjustments if the measured flow rate of the feed mixture is decreased:

a. decreasing the amount of the second portion of the methane-rich bottoms liquid that is vaporized in the heat exchanger against the feed mixture in order to maintain the cold feed mixture at the first temperature;

b. decreasing the flow rate of the methane-rich bottoms liquid withdrawn from the storage section of the distillation column, thereby raising the volume of liquid within the storage section of the distillation column.

* * * * *